United States Patent [19]

Wrobel

[11] Patent Number: 4,729,714

[45] Date of Patent: Mar. 8, 1988

[54] BUILT-IN FAN

[75] Inventor: Guenter Wrobel, Villingen, Fed. Rep. of Germany

[73] Assignee: Papst-Motoren GmbH & Co. KG, St. Georgen, Fed. Rep. of Germany

[21] Appl. No.: 858,704

[22] Filed: May 2, 1986

[30] Foreign Application Priority Data

May 2, 1985 [CH] Switzerland ..... 1855/85

[51] Int. Cl.[4] ..... F04D 29/66

[52] U.S. Cl. ..... 415/119; 415/195; 416/200 R; 416/203

[58] Field of Search ..... 415/119, 191, 192, 193, 415/194, 195, 181; 416/203, 200 R, 183, 201 R, 201 A

[56] References Cited

U.S. PATENT DOCUMENTS

| | | | |
|---|---|---|---|
| 484,511 | 10/1892 | Adams | 416/200 R |
| 2,948,506 | 8/1960 | Glasser et al. | 415/119 |
| 3,178,099 | 4/1965 | Child | 415/119 |
| 3,347,520 | 10/1967 | Owczarek | 415/119 |

FOREIGN PATENT DOCUMENTS

| | | | |
|---|---|---|---|
| 3022477 | 5/1982 | Fed. Rep. of Germany | 415/119 |
| 3042431 | 6/1982 | Fed. Rep. of Germany | 415/119 |
| 854865 | 4/1940 | France | 416/201 A |
| 2470879 | 6/1981 | France | 415/119 |
| 123712 | 9/1979 | Japan | 415/119 |
| 361316 | 1/1973 | U.S.S.R. | 416/203 |

*Primary Examiner*—Robert E. Garrett
*Assistant Examiner*—John T. Kwon
*Attorney, Agent, or Firm*—Barnes & Thornburg

[57] ABSTRACT

In an axial fan whose fan wheel is retained in a tubular member by spokes, the blade edges of the individual fan blades which face the spokes are constructed geometrically different from one another.

20 Claims, 12 Drawing Figures

BUILT-IN FAN

The present invention relates to a built-in fan with a fan wheel which is coaxially supported in a tubular member of a housing, in which the hub of the fan wheel is rotor of a centrally supported driving motor whose stator is supported at the tubular member by means of radially directed spokes extending closely at one end of the fan wheel, and with fan blades which are distributed over the circumference of the fan wheel and extend into the space between hub and the tubular member.

Fans of this type are already of compact construction by reason of the limited space for their installation which is only available as a rule. This has as a consequence that the respective edges of the fan blades sweep closely along the spokes and thereby induce turbulences which lead to disturbing noises. These disturbing noises are particularly unpleasant tones if the inductions repeat periodically very rapidly or add synchronously.

For this reason, with a prior art built-in fan of the aforementioned type in which the spokes and the fan blades are each uniformly distributed over the circumference, one has so selected the division relationship between the number of the spokes and the number of fan blades that it is not divisible by an integer. For the same reason, measures were taken with such a prior art fan that the spokes can never come into parallel position with respect to the fan edges facing the same. As a result of these measures, the undesirable fan noises caused by turbulences can be reduced.

It is the principal object of the present invention to reduce with a built-in fan of the aforementioned type the fan noises which are induced by turbulences as far-reachingly as possible in the simplest possible manner.

The present invention is characterized in that the blade edges of adjacent fan blades which face the spokes, differ from one another with respect to a plane perpendicular to the axis and passing through the parts of the spoke facing most close the fan blades as regards spacing, inclination, curvature, length and/or direction.

As a result of the introduced non-uniformity, the turbulences generated by adjacent fan blades are no longer synchronous with the frequency of the blade rotation and therefore also cannot add any longer to a single tone.

One can achieve the desired effect in that one makes different one of the dimensions--spacing, inclination, curvature, length or direction. The reduction, however, becomes more pronounced if one makes several of the mentioned dimensions different.

One achieves already a reduction of the noise development if the adjacent fan blades differ in the indicated manner; however, the noise suppression becomes greater if each fan blade differs in the indicated manner with respect to all other fan blades.

Particularly effective noise suppression with relative slight constructive deviations from the uniform construction is achieved if the differences involve length and curvature.

In mass production, certain minimal differences conditioned on tolerances cannot be avoided. However, such differences are not meant herein, instead the present invention is concerned with clear differences which lie considerably above the unavoidable differences which are caused by tolerances. A difference conditioned by differentiation amounts preferably to at least 10% of the respective dimension which means if the inclination is 5°, the difference is at least 0.5°. If, as is preferred, all fan blades are to differ with respect to all of the remaining fan blades and if five fan blades are provided, then the inclination of the respective five fan blades may amount to: 5°, 5.5°, 6°, 6.5°, 7°. The fan blades are then not distributed over the circumference with increasing inclination but rather will be arranged scattered or random in relation to the inclination.

The present invention can be combined very advantageously with the known measures described hereinabove for the noise suppression. Consequently, a preferred further development of the invention is characterized in that the spokes and the fan blades are each distributed uniformly over the circumference and that the number of the provided spokes is not divisible by an integer by the number of the provided fan blades.

A further preferred embodiment of the present invention is characterized in that the axial projections of the spokes, on the one hand, and the edges of the fan blades facing the spokes, on the other, are non-parallel to one another in every rotational position of the fan wheel.

These and other objects, features and advantages of the present invention will become more apparent from the following description when taken in connection with the accompanying drawing which shows, for purposes of illustration only, several embodiments in accordance with the present invention, and wherein.

Figure 1:
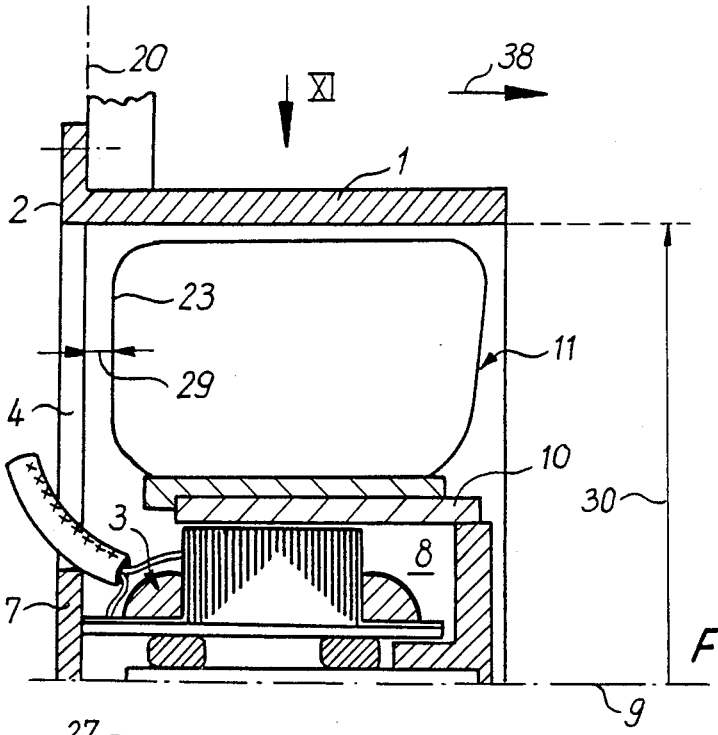
FIG. 1 is a cross-sectional view through the upper half of a built-in fan in accordance with the present invention, built into an assembly wall.

Referring now to the drawing, wherein similar reference numerals are used throughout the various views to designate like parts, reference numeral 1 designates a cylindrically shaped tubular member which at its end edge 2 located on the suction side includes three radially inwardly directed spokes 4, 5 and 6 offset by 120° which carry a centrally located bearing shield 7 for the stator generally designated by reference number 3 of a driving motor 8. The motor axis is designated by reference numeral 9. The rotor is at the time the hub 10 of the fan wheel generally designated by reference numeral 11 which is arranged coaxially to the axis 9 completely inside of the tubular member 1. The hub 10 is provided with fan blades 12 to 16 which are distributed uniformly over the circumference and which extend in the space between hub 10 and tubular member 1.

Altogether three spokes and five fan blades are provided. The division ratio 3:5 is not an integer.

The spokes 4, 5 and 6 extend in the radial direction within a plane perpendicular to the axis 9. The spokes 4, 5 and 6 define the spoke plane 20 with their portions facing the fan blades most closely; the spoke plane 20 is also perpendicular to the axis 9. The fan blade edges 22 to 26 extend directly opposite this spoke plane 20 with a relatively small spacing in the interest of a compact construction. In relation to the axial projection in FIG. 2, these fan blade edges 22 to 26 extend at an acute angle 27 to the radial direction 28. Consequently, they can never assume a position parallel to the spokes during the rotation which is favorable for the noise suppression.

Figure 2:
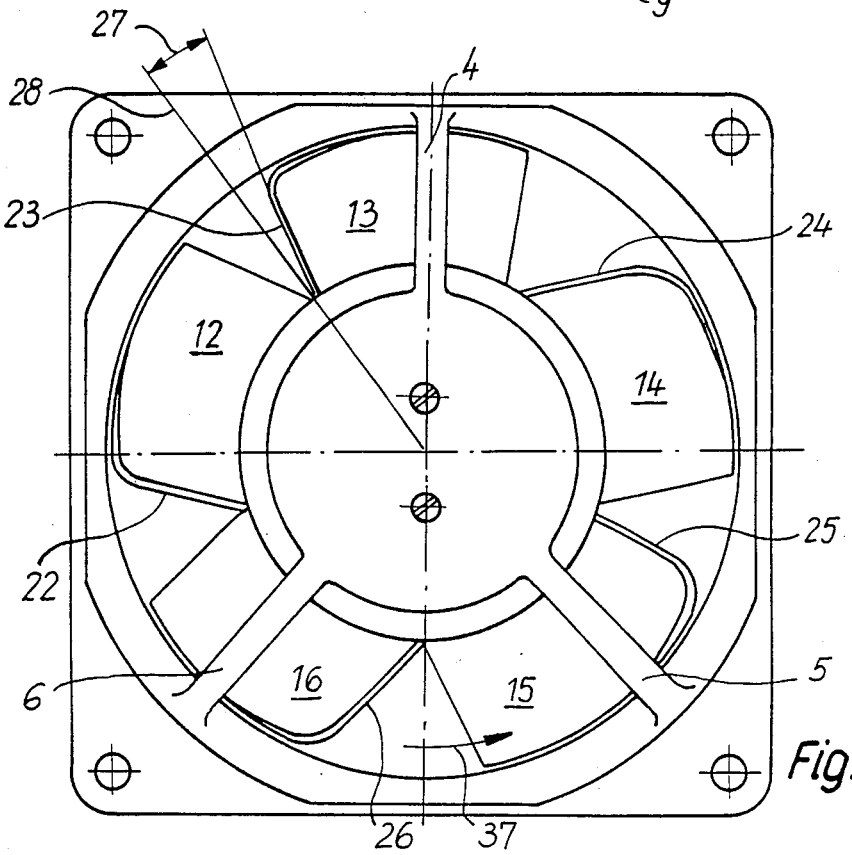
FIG. 2 is an elevational view of the built-in fan of FIG. 1, taken in the direction of arrow II of FIG. 1.

The two measures for the noise suppression which have been described and realized so far in connection with the embodiment according to FIGS. 1 and 2; namely, a division ratio, number of spokes and of the fan blades which cannot be divided by an integer, and the constant non-parallelity of the axial projections of the spokes and the fan blade edges facing the same are part of the state of the art. They are used in this embodiment as additional measures for the noise suppression because they are not inconsistent with the present invention. However, one can also dispense with these measures. The measures for the noise suppression which are provided in this embodiment according to the present invention will be described hereinafter.

The fan blade edge 23 extends, as can be seen from FIG. 1, parallel to the spoke plane 20. The distance according to the double arrow 29 amounts to 5% of the inner radius 30 of the tubular member 1. This distance according to double arrow 29 is different for the respective blade edges and more particularly for the blade edge 24, it amounts to 7%, for the blade edge 25 to 9%, for the blade edge 26 to 6% and for the blade edge 22 to 8%.

The direction of rotation is indicated by the arrow 37 (FIG. 2). A flow direction according to arrow 38 (FIG. 1) corresponds to this direction of rotation. FIG. 12 shows schematically the five blades of FIG. 11 as blades $III^{I}$–$III^{V}$ with corresponding five different angles of attack E1–E5 and with five different recess distances $29^{I}$–$29^{V}$, respectfully. Accordingly, the spokes are located on the suction side. However, the spokes can also be located on the pressure side; in that case the present invention is equally applicable, it is only essential that the measures of this invention then refer to the respective fan blade edges facing the spokes.

The embodiments to be described hereinafter differ from the embodiment according to FIGS. 1 and 2 only by the features specially indicated hereinafter.

In these embodiments the spokes are designated by reference numerals 40 to 51 and the fan blades by reference numerals 60 to 79. The fan blades facing the spokes are designated by reference numerals 80 to 99.

Figure 3:
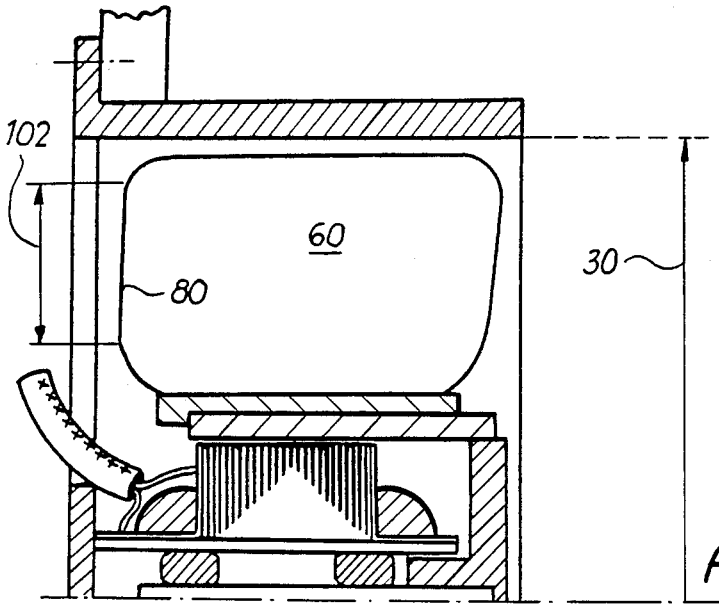
FIGS. 3 to 10 are, respectively, cross-sectional and elevational views corresponding to FIGS. 1 and 2 of further embodiments of a built-in fan in accordance with the present invention.
Figure 4:
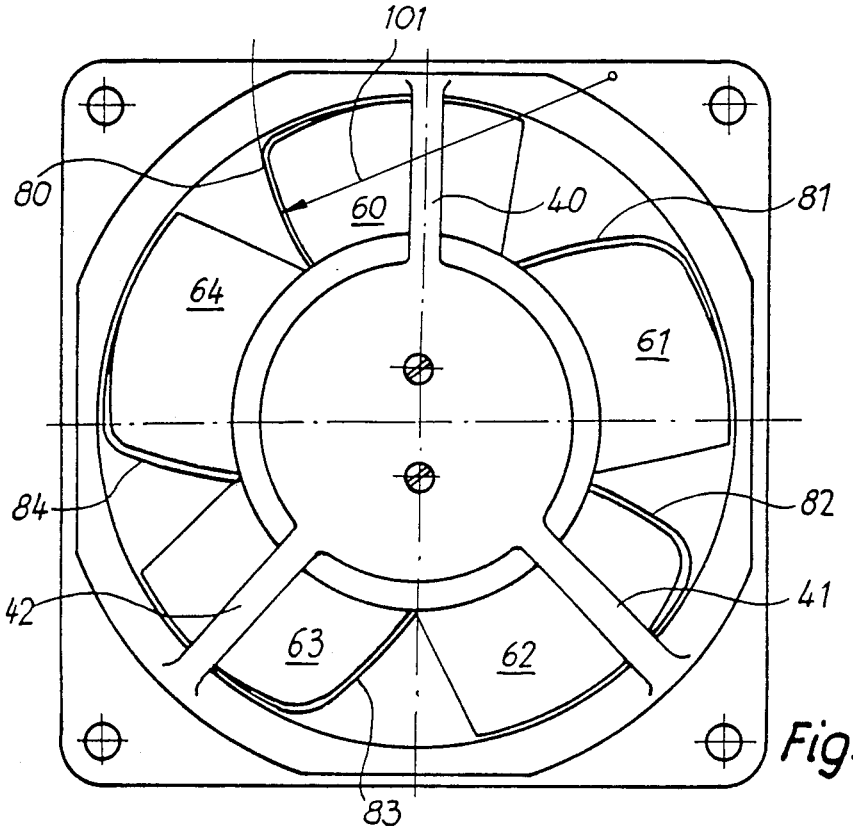

According to FIG. 4, the blade edge 80 is curved about a radius 101. The radius 101 amounts to 80% of the radius 30. This radius, and therewith also the corresponding curvature, is different with all fan blade edges 80 to 84, and more particularly, in relation to the radius 30, it amounts to 220% for the fan blade edge 81, to 160% for the fan blade edge 82, to 200% for the fan blade edge 83 and to 140% for the fan blade edge 84. The length of the fan blade edge 80 according to the double arrow 102 (FIG. 3), amounts to 30% of the radius 30. This length is different with the other fan blades, and more particularly, it amounts to 38% for the fan blade edge 81, to 26% for the fan blade edge 82, to 34% for the fan blade edge 83 and to 22% for the fan blade edge 84.

Figure 5:
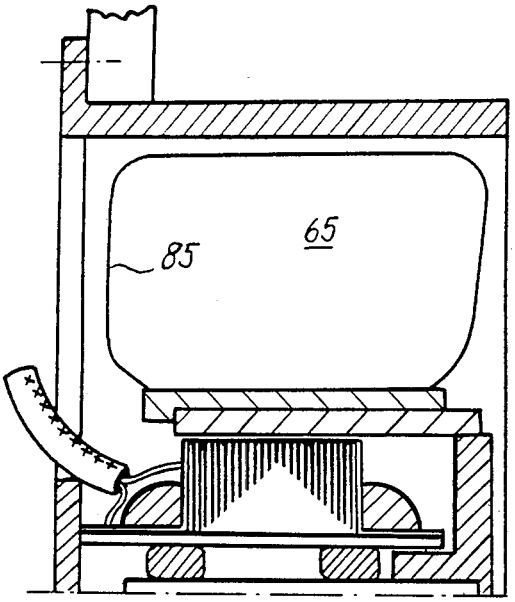
Figure 6:
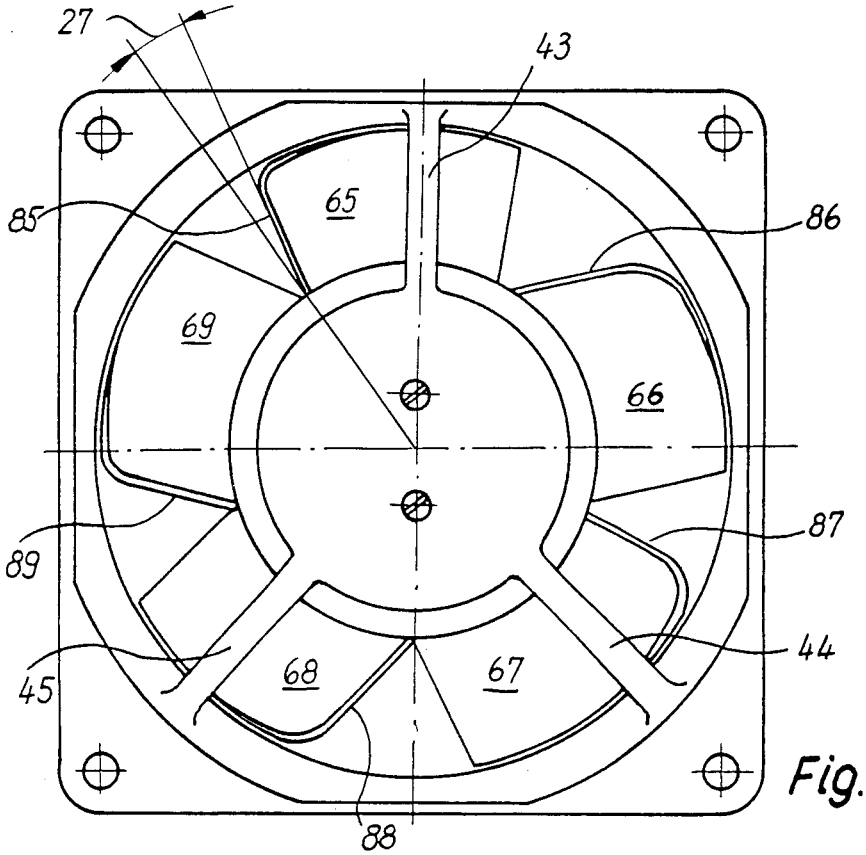

According to FIGS. 5 and 6, the acute angle 27 for the fan blade edge 85 amounts to 10°. The corresponding angle for the other fan blade edges is different, and more particularly it amounts to 39° for the fan blade edge 86, to 30° for the fan blade edge 87, to 36° for the fan blade edge 88 and to 33° for the fan blade edge 89.

Figure 7:
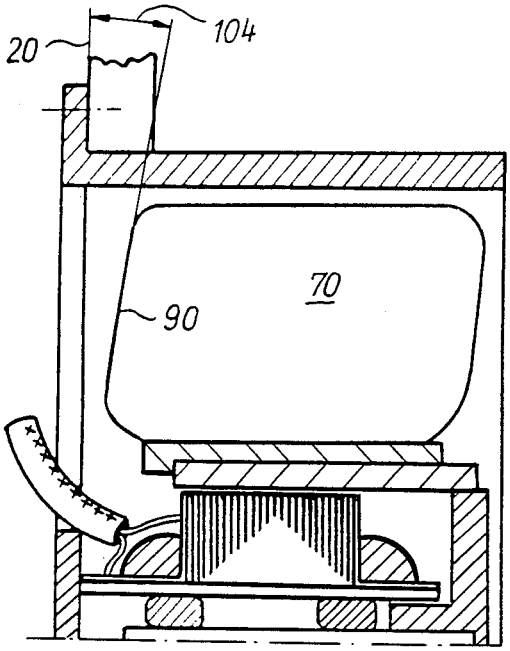
Figure 8:
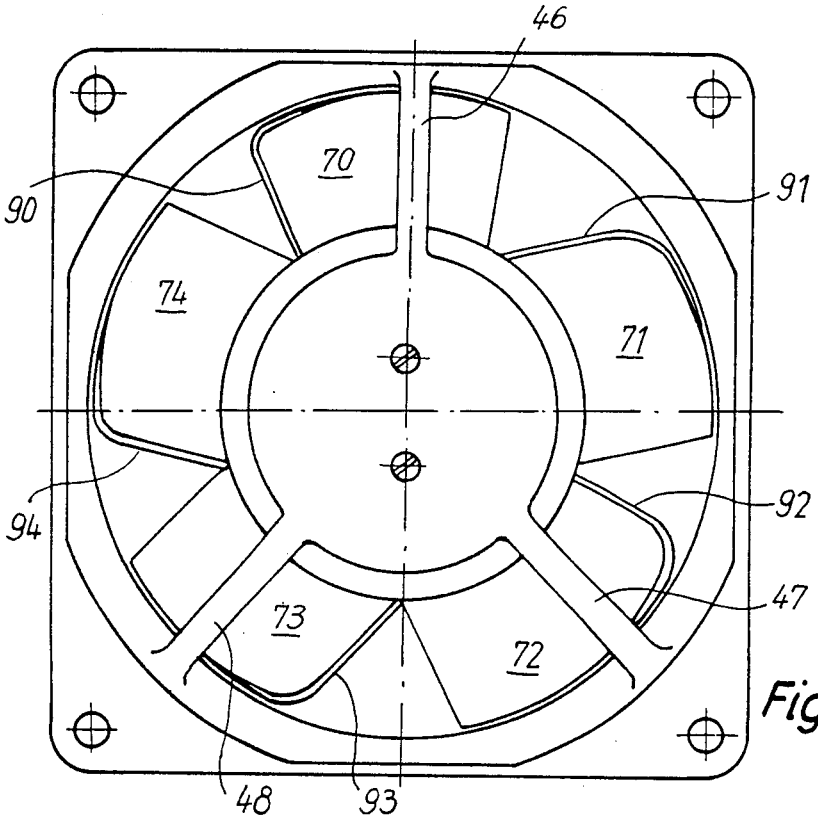

According to FIG. 7, the fan blade edge 90 is at an acute angle 104 to the spoke plane 20. This acute angle amounts to 12° for the fan blade edge 90, to 18° for the fan blade edge 91, to 14° for the fan blade edge 92, to 20° for the fan blade edge 93 and to 16° for the fan blade edge 94.

Figure 9:
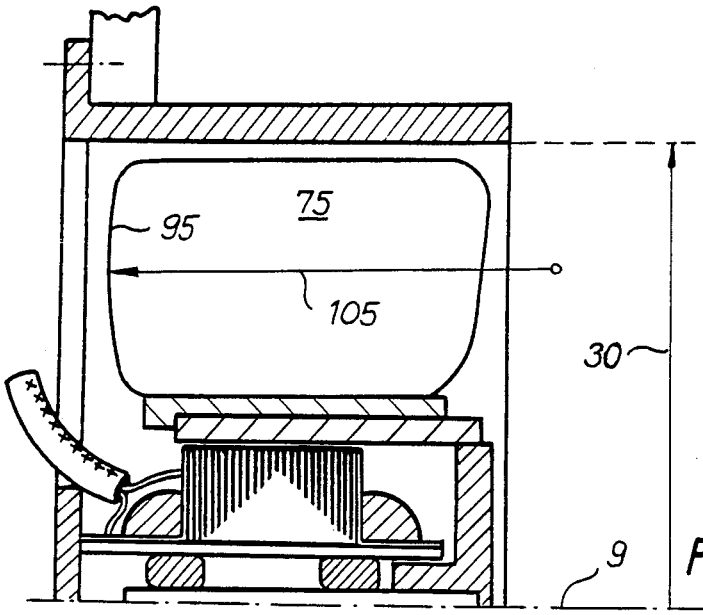
Figure 10:
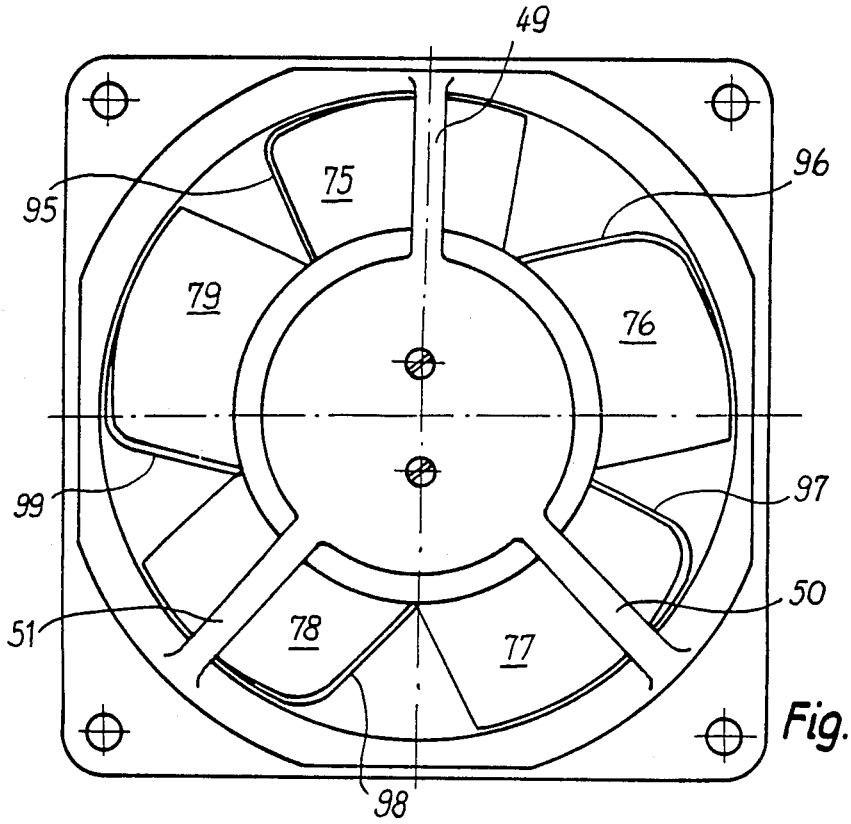

In the embodiment illustrated in FIG. 9, the fan blade edge 95 is curved about a radius 105 which extends parallel to the axis 9. The length of this radius 105 amounts to 100% of the radius 30 for the fan blade edge 95, to 180% for the fan blade edge 96, to 60% for the fan blade edge 97, to 200% for the fan blade edge 98 and to 120% for the fan blade edge 99.

The dimensional differences described in connection with the different embodiments can also be combined with each other in other embodiments. In other words, the dimensional differences of the fan blade edges can also be combined in a single embodiment, for example, those from the embodiment according to FIGS. 3 to 6.

Figure 11:
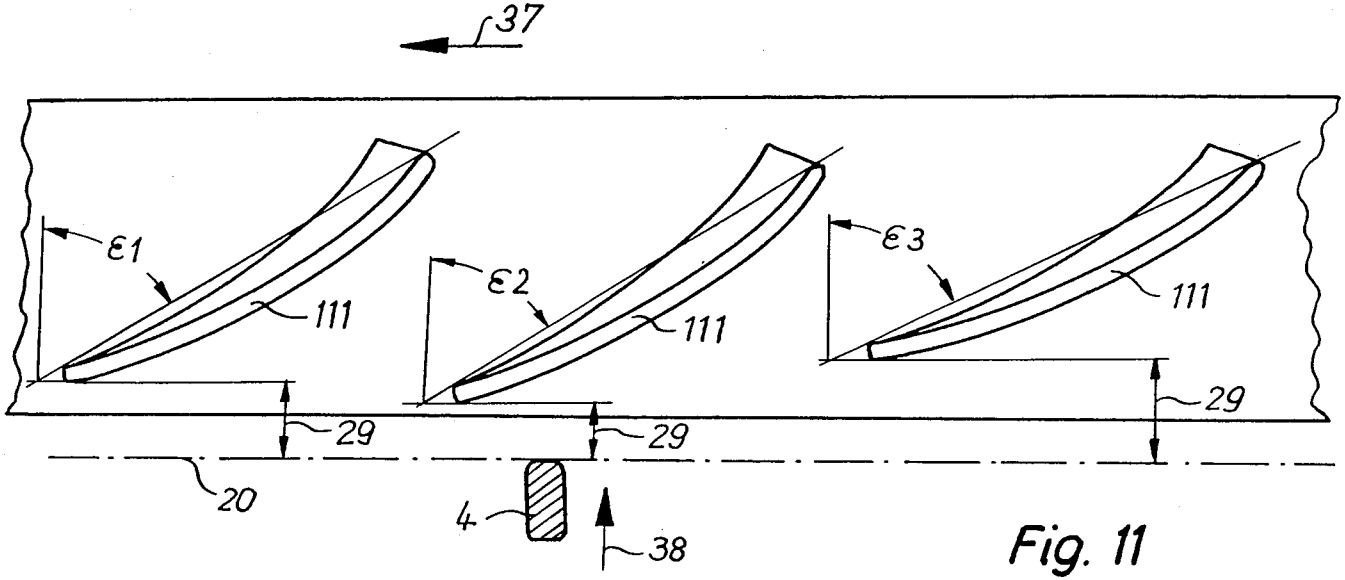
FIG. 11 is a part of a development of a further embodiment of a fan wheel in accordance with this invention, taken in the direction of the arrow XI in FIG. 1.
Figure 12:
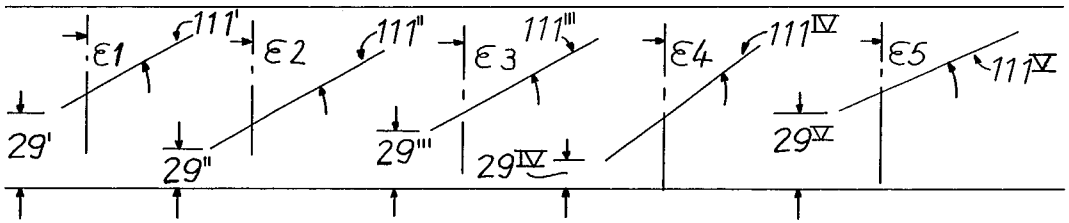
FIG. 12 shows schematically 5 blades having different angles and recesses.

FIG. 11 illustrates a part of a development of a fan wheel with fan blades 111 taken in the direction of arrow XI in FIG. 1. The tubular member 1 and other details are thereby omitted. As in FIG. 1, five fan blades 111 are also provided in this embodiment (only 3 of which are shown) which are all identical with each other, i.e., have the same shape but are arranged on the hub 10 with different angles of incidence or angles of attack (E1, E2, E3, ) so that also in this case the distance according to the double arrow 29 is different for each blade edge as, for example, in FIG. 1. This embodiment is of interest in particular for fans which have already been produced because existing parts can be used and, as with the other described embodiments, a considerable noise reduction is achieved with an essentially equal output.

Whereas a non-uniform blading by a dissimilar blade distribution, that is irregular, non-equidistant positions of identical blades over the circumference is known, the present invention provides dissimilarities on the blades themselves, especially at the blade edges facing the spokes. In addition to the mentioned magnitudes to be varied in accordance with the present invention, also the blade outline or cross section, the blade thickness, the angle of attack or incidence, the blade curvature itself, respectively, the twist of the blades may additionally be non-uniform or irregular, that is, may vary. These magnitudes are linked in part with the magnitudes mentioned first hereinabove.

It is also noted that the spokes extend inwardly (essentially radially) from the one end of the external tubular member; however, the term "generally radially directed spokes" is to be understood to include both rectilinear as also curved spokes having relatively large acute angles (of up to about 60°).

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A fan comprising fan wheel means, a housing means including a tubular member, said fan wheel means being supported substantially coaxially in said tubular member, said fan wheel means including a hub forming the rotor means of a centrally supported driving motor whose stator means is supported at the tubular member by generally radially directed spokes extending closely at one end of the fan wheel means, and fan blade means distributed over the circumference of the fan wheel means and extending in the space between the hub and tubular member to limit turbulence generated by adjacent fan blade means so that the turbulence is not in synchronism with the frequency of rotation of the fan blade means, the blade edges of adjacent fan blade means which face the spokes differing from another as regards at least one dimension of spacing, inclination, curvature, length and direction with respect to a plane substantially perpendicular to the fan axis and passing through the part of the spokes most close to the fan blade edges.

2. A fan according to claim 1, wherein each fan blade means possesses the differentiations with respect to all other fan blade means.

3. A fan according to claim 2, wherein the differentiations involve length and curvature.

4. A fan according to claim 3, wherein a difference conditioned on the differentiation amounts to about 10% of the respective dimension.

5. A fan according to claim 4, wherein the spokes and the fan blade means are uniformly distributed over the circumference and the number of the provided spokes is not divisible by an integer by the number of the provided fan blade means.

6. A fan according to claim 5, wherein the axial projections of the spokes, on the one hand, and of the edges of the fan blade means facing the spokes, on the other, are non-parallel to one another in every rotational position of the fan wheel means.

7. A fan according to claim 1, wherein different distances between the spokes and the fan blade edges facing the spokes are formed by at least one of differing inclination and angle of attack with respect to the axis of adjacent fan blade means of similar shape.

8. A fan according to claim 7, wherein a difference conditioned on the differentiation amounts to about 10% of the respective dimension.

9. A fan according to claim 7, wherein the spokes and the fan blade means are uniformly distributed over the circumference and the number of the provided spokes is not divisible by an integer by the number of the provided fan blade means.

10. A fan according to claim 9, wherein the axial projections of the spokes, on the one hand, and of the edges of the fan blade means facing the spokes, on the other, are non-parallel to one another in every rotational position of the fan wheel means.

11. A fan according to claim 1, wherein the differentiations involve length and curvature.

12. A fan according to claim 1, wherein a difference conditioned on the differentiation amounts to about 10% of the respective dimension.

13. A fan according to claim 1, wherein the spokes and the fan blade means are uniformly distributed over the circumference and the number of the provided spokes is not divisible by an integer by the number of the provided fan blade means.

14. A fan according to claim 1, wherein the axial projections of the spokes, on the one hand, and of the edges of the fan blade means facing the spokes, on the other, are non-parallel to one another in every rotational position of the fan wheel means.

15. A fan comprising fan wheel means, a housing means including a tubular member, said fan wheel means being supported substantially coaxially in said tubular member, said fan wheel means including a hub forming the rotor means of a centrally supported driving motor whose stator means is supported at the tubular member by generally radially directed spokes extending closely at one end of the fan wheel means, and fan blade means distributed over the circumference of the fan wheel means and extending in the space between the hub and tubular member to limit turbulence generated by adjacent fan blade means so that the turbulence is not in synchronism with the frequency of rotation of the fan blade means, the blade edges of adjacent fan blade means which face the spokes differing from one another with respect to a surface extending through the parts of the spokes closest to the fan blade edges as regards at least one of spacing, inclination, curvature, length and direction.

16. A fan according to claim 15, wherein the surface is a plane substantially perpendicular to the fan axis.

17. A fan according to claim 16, wherein the distances between the forward wing roots are equal.

18. A fan according to claim 15, wherein the distances between the forward wing roots are equal.

19. A fan comprising fan wheel means, a housing means including a tubular member, said fan wheel means being supported substantially coaxially in said tubular member, said fan wheel means including a hub forming the rotor means of a centrally supported driving motor whose stator means is supported at the tubular member by generally radially directed spokes extending closely at one end of the fan wheel means, and fan blade means distributed over the circumference of the fan wheel means and extending in the space between the hub and tubular member to limit turbulence generated by adjacent fan blade means so that the turbulence is not in synchronism with the frequency of rotation of the fan blade means, at least a part of the blade edges of adjacent fan blade means which face the spokes being of unequal construction.

20. A fan according to claim 19, wherein the distances between the forward wing roots are equal.

* * * * *